US006805559B2

(12) United States Patent
Mak

(10) Patent No.: US 6,805,559 B2
(45) Date of Patent: Oct. 19, 2004

(54) ERASABLE GRAPHIC PANEL

(75) Inventor: Kai-Shun Mak, Kwai Chung (CN)

(73) Assignee: Hop Lee Cheong Industrial Company Limited, Hong Kong (CN)

( * ) Notice: Subject to any disclaimer, the term of this patent is extended or adjusted under 35 U.S.C. 154(b) by 0 days.

(21) Appl. No.: 10/308,582

(22) Filed: Dec. 3, 2002

(65) Prior Publication Data

US 2004/0115610 A1 Jun. 17, 2004

(51) Int. Cl.[7] ..... B43L 1/12
(52) U.S. Cl. ..... 434/410
(58) Field of Search ..... 434/408, 409, 434/410, 417, 418

(56) References Cited

U.S. PATENT DOCUMENTS 2,167,296 A * 7/1939 Farmer ..... 15/98
4,011,665 A * 3/1977 Port ..... 434/410
4,801,266 A * 1/1989 Kinberg ..... 434/81
5,324,202 A * 6/1994 Meyers et al. ..... 434/410
5,478,084 A * 12/1995 Itkis ..... 273/239
5,791,910 A * 8/1998 Masson et al. ..... 434/410

OTHER PUBLICATIONS

"Fisher Price Brilliant Basics Musical Finger Paint", 2001 [retrieved online Sep. 25, 2003].*

* cited by examiner

*Primary Examiner*—Kurt Fernstrom
(74) *Attorney, Agent, or Firm*—Alix, Yale & Ristas, LLP

(57) ABSTRACT

An erasable graphic panel includes a substrate having a dark surface, a translucent film overlying the substrate and adapted upon application of pressure from a pointed implement to adhere locally to the substrate and thereby produced a visible trace of movement of the pointed implement upon the film. The panel also includes a slider positioned over the substrate and having a lifting blade extending under the film and being movable across the substrate to lift the film and thereby erase the visible trace.

1 Claim, 4 Drawing Sheets

ERASABLE GRAPHIC PANEL

BACKGROUND OF THE INVENTION

The present invention relates to an erasable graphic panel. More particularly, although not exclusively, the invention relates to a panel having a dark or coloured substrate and a semi-adhesive translucent film which when pressed in a localised area against the substrate by a pressing tip, turns dark or coloured to simulate writing or drawing. More particularly, the invention relates to such a panel having a special erasing slider for separating the translucent film from the substrate to thereby erase any graphic image showing through the film.

It is known to provide graphic panels having a pressure-sensitive translucent plastics film upon a dark rubbery-surfaced substrate. When an inkless writing tip is pressed against the translucent film, the film appears to turn dark due to adhesion of the back surface of the film at the pressed areas to the substrate and this simulates writing or drawing. Various methods have been developed for erasing the writing from the panels. These are usually expensive as they suffer from complexity of design.

OBJECT OF THE INVENTION

It is an object of the present invention to overcome or substantially ameliorate the above disadvantage and/or more generally to provide an improved erasable graphic panel.

DISCLOSURE OF THE INVENTION

There is disclosed herein an erasable graphic panel comprising:

a substrate having a dark surface, a translucent film overlying the substrate and adapted upon application of pressure from a pointed implement thereto to adhere locally to the substrate and thereby produced a visible trace of movement of the pointed implement upon the film, and a slider positioned over the substrate and comprising a lifting blade extending under the film and being movable across the substrate to lift the film therefrom to thereby erase the visible trace.

Preferably the slider comprises a deflector that is parallel and coextensive with the lifting blade and under which the film passes.

Preferably the substrate is positioned upon a base that comprises parallel tracks, one at either lateral side of the substrate, and wherein the slider comprises a guide at both ends of the blade, each riding along a respective said track.

Preferably a handle extends from the deflector for grasping by a user.

Preferably the panel includes a frame attached to the base and covering a periphery of the film and extending over the tracks to constrain the guides in the tracks.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
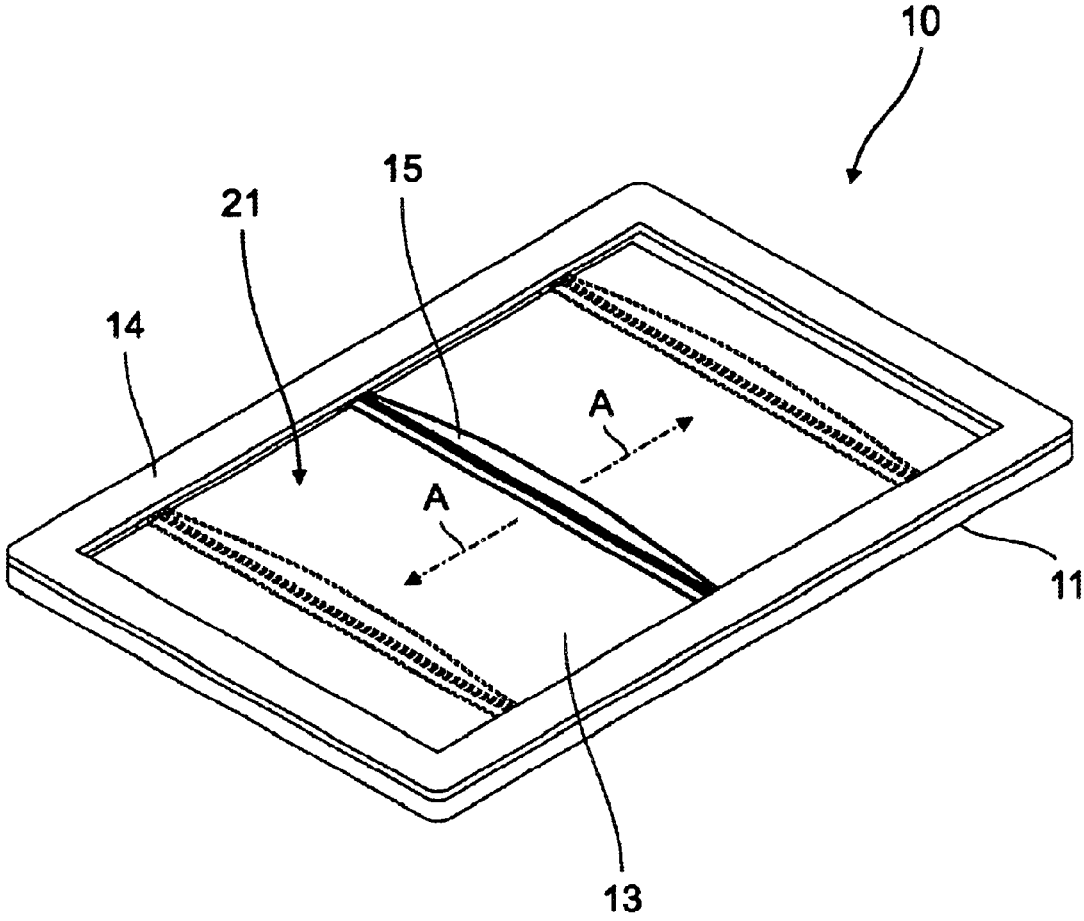
FIG. 1 is a schematic perspective illustration of an erasable graphic panel.

In the accompanying drawings there is depicted schematically an erasable graphic panel 10. Panel 10 might typically be formed of plastics or cardboard parts, or parts of other material and comprises a base 11 upon which there is affixed a frame 14. The frame 14 defines a rectangular window area 21 along which a slider 15 can be moved in the directions indicated by the arrows A.

Situated between the frame 14 and the base 11 is a substrate 12 of dark rubbery material known in the art of pressure sensitive writing panels. Overlying the substrate 12 is a flexible translucent plastics film 13. The frame 14 covers the periphery of the film 13.

If a pointed implement such as an inkless pen for example is pressed onto the film 13 and moved with drawing or writing strokes, the film 13 will temporarily adhere to the substrate 12 to show a dark image trace of the pen's contact with a film. The trace is in fact a line of adherence between the back surface of the film and the substrate and is visible through film in the window 21. If the film 13 is lifted from the substrate, the trace will disappear.

Figure 2:
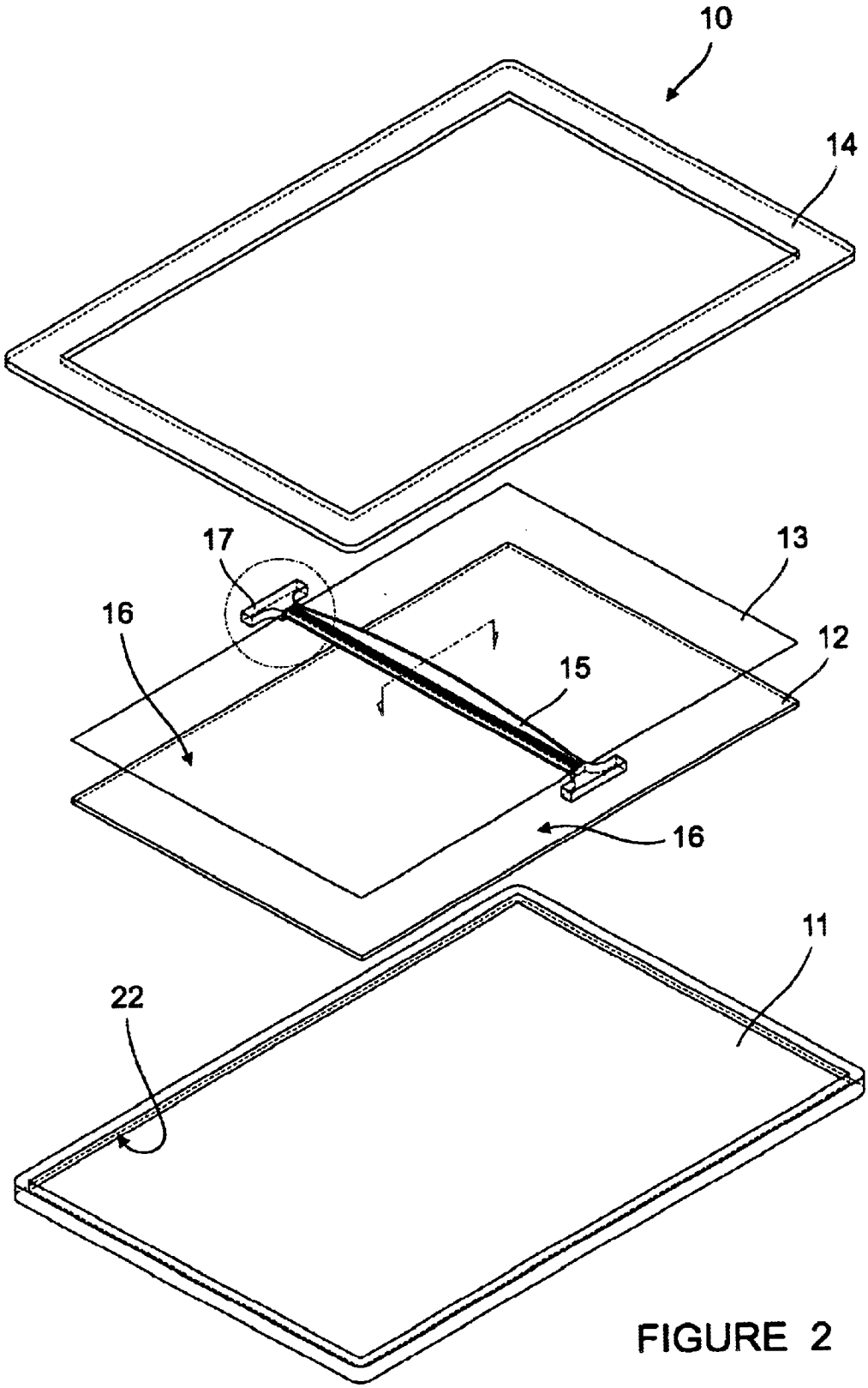
FIG. 2 is a schematic parts-exploded perspective illustration of the panel of FIG. 1.
Figure 3:
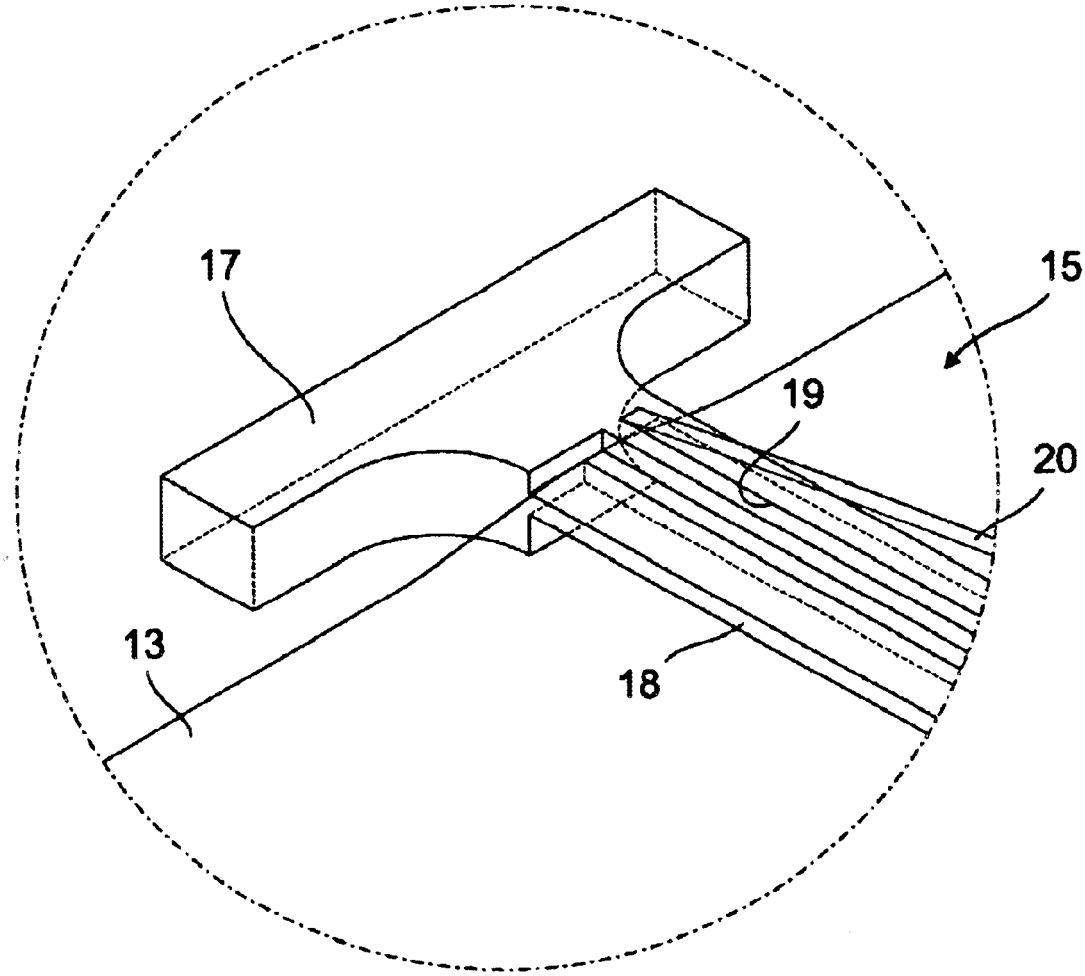
FIG. 3 is a schematic detailed illustration of an end portion of a slider forming part of the panel of FIGS. 1 and 2.

The slider 15 is typically formed of moulded plastics material and comprises a blade 18 extending under the film 13 from one lateral edge of the film to the other. At each end of the blade, there is a guide 17 that slides along tracks 16 formed at either lateral edge of the substrate 12. The tracks are in the form of longitudinal channels having as their bottom an upper surface of the base 11. One side of each channel is formed by lateral edges of the substrate 12. The other side of each channel is formed by an inner edge 22 of the base (see FIG. 2). The guides are constrained within the channels by virtue of the frame 16. The frame can be adhered to the base about its periphery or otherwise connected thereto.

Figure 4:
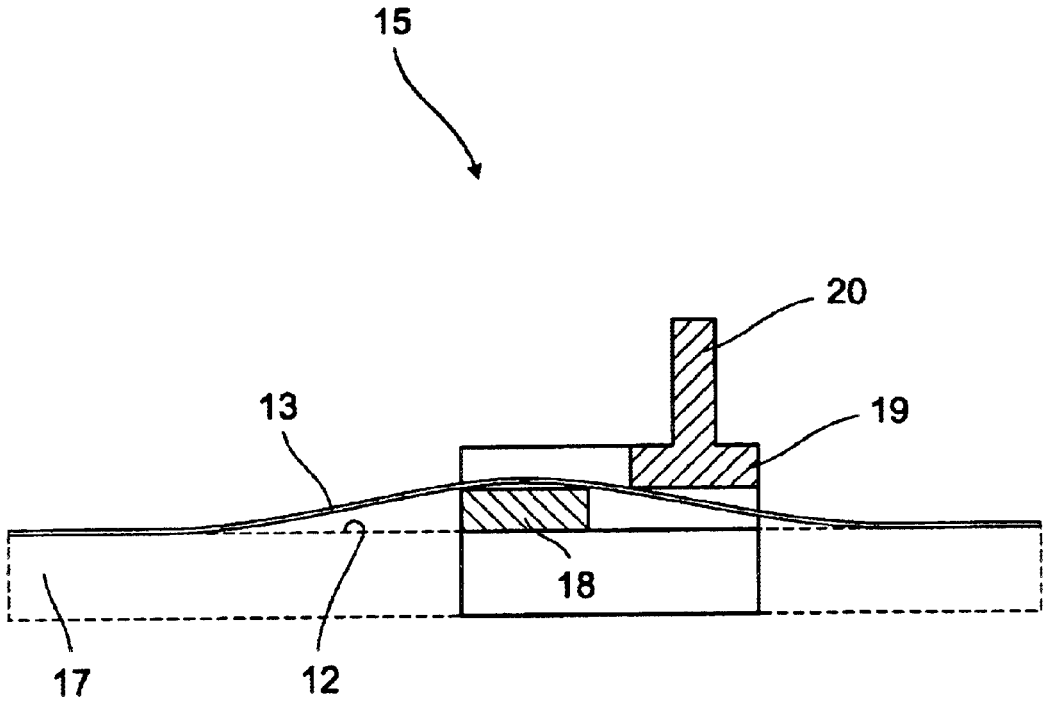
FIG. 4 is a schematic cross-sectional end elevational view of the slider of FIG. 3.

The guides 17 move along the tracks 16 to keep the blade 18 extending transversely as it moves longitudinally along the panel 10. Also extending between the guides 17 is a deflector 19 that passes over the film 13. A handle 20 extends from the deflector 19 for grasping by a user to cause longitudinal movement of the slider 15 when it is desired to erase text and/or images displayed by the panel. As shown in FIG. 4, the film 13 is lifted by the blade 18 and passes under the deflector 19. As the bottom surface of the film 13 lifts away from the substrate 12, the image resulting from adhesion disappears.

It should be appreciated that modifications and alterations obvious to those skilled in the art are not to be considered as beyond the scope of the present invention. For example, the panel need not be rectangular in shape and the slider need not move linearly. In an alternative configuration, the display area might be circular and the slider might be fixed at the centre of the circle somewhat like a hand of a clock. To this end, there might be a hole in the centre of the film through which a shaft would extend for attaching the slider to the base.

What is claimed is:

1. An erasable graphic panel comprising:

a substrate having a dark surface, said substrate positioned upon a base that comprises parallel tracks, one at either lateral side of the substrate;

a translucent film overlaying the substrate and adapted upon application of pressure from a pointed implement thereto to adhere locally to the substrate and thereby produce a visible trace of movement of the pointed implement upon the film;

a slider positioned over the substrate and comprising a lifting blade extending under the film and being movable across the substrate to lift the film therefrom to thereby erase the visible trace, the slider further comprising a guide at both ends of the blade, each riding along a respective said track; and a frame attached to the base and covering a periphery of the film and extending over the tracks to constrain the guides in the tracks.

* * * * *